US005652648A

United States Patent [19]

Behe et al.

[11] Patent Number: 5,652,648

[45] Date of Patent: Jul. 29, 1997

[54] NEGATIVE WRAP BACK UP ROLL ADJACENT THE TRANSFER NIP

[75] Inventors: Thomas J. Behe, Webster; Grace T. Brewington, Fairport; Jeffrey J. Folkins, Rochester; William H. Wayman, Ontario, all of N.Y.

[73] Assignee: Xerox Corporation, Stamford, Conn.

[21] Appl. No.: 536,221

[22] Filed: Sep. 29, 1995

Related U.S. Application Data

[63] Continuation-in-part of Ser. No. 164,493, Dec. 9, 1993, abandoned.

[51] Int. Cl.[6] ..... G03G 15/00; G03G 15/08

[52] U.S. Cl. ..... 399/164; 399/279

[58] Field of Search ..... 355/212, 245, 355/259; 100/154

[56] References Cited

U.S. PATENT DOCUMENTS

| | | | |
|---|---|---|---|
| 3,844,906 | 10/1974 | Bailey et al. | 204/9 |
| 3,869,612 | 3/1975 | Lenhard | 355/212 X |
| 3,876,510 | 4/1975 | Wallin et al. | 204/9 |
| 3,931,792 | 1/1976 | Sato | 355/245 X |
| 4,034,709 | 7/1977 | Fraser et al. | 118/658 |
| 4,067,782 | 1/1978 | Bailey et al. | 204/25 |
| 4,096,826 | 6/1978 | Stange | 355/212 X |
| 4,186,162 | 1/1980 | Daley | 264/46.5 |
| 4,230,406 | 10/1980 | Klett | 355/305 |
| 4,279,496 | 7/1981 | Silverberg | 355/212 |
| 4,372,247 | 2/1983 | Calabrese | 29/130 |
| 4,440,295 | 4/1984 | Blackwood-Murray et al. | 198/843 |
| 4,501,646 | 2/1985 | Herbert | 204/4 |
| 4,566,781 | 1/1986 | Kuehnle | 355/256 |
| 4,583,272 | 4/1986 | Keller | 29/110 |
| 4,614,420 | 9/1986 | Lubinsky et al. | 355/251 |
| 4,699,500 | 10/1987 | Lubberts et al. | 355/212 |
| 4,769,671 | 9/1988 | Koff | 355/212 |
| 4,841,613 | 6/1989 | Beery et al. | 29/130 |
| 4,868,600 | 9/1989 | Hays et al. | 355/259 |
| 4,961,089 | 10/1990 | Jamzadeh | 355/326 X |
| 5,087,946 | 2/1992 | Dalal et al. | 355/285 |
| 5,168,318 | 12/1992 | Haneda et al. | 355/212 X |
| 5,177,538 | 1/1993 | Mammino | 355/259 |
| 5,229,813 | 7/1993 | Cherian | 355/200 |

*Primary Examiner*—Nestor R. Ramirez
*Attorney, Agent, or Firm*—John S. Wagley

[57] ABSTRACT

An apparatus for developing a latent image recorded in a surface of a flexible photoconductive member. The apparatus includes a developer unit having a developer roll and a backing member. The roll is positioned opposed from the surface of the flexible photoconductive member and is used for developing the latent image with developer material. The backing member has an arcuate surface in engagement with a surface of the flexible photoconductive member opposed from the surface having the latent image recorded thereon. The flexible photoconductive member is wrapped about at least a portion of the arcuate surface of the backing member to form a negative wrap angle opposed from the developer unit. The centerpoint of the developer roll, the centerpoint of the backing member and the centerpoint of the arcuate surface are colinear.

18 Claims, 8 Drawing Sheets c

NEGATIVE WRAP BACK UP ROLL ADJACENT THE TRANSFER NIP

This application is a continuation in part of U.S. patent application Ser. No. 08/164,493 filed Dec. 9, 1993, attorney docket number D/93314, incorporated herein by reference now abandoned.

The present invention relates to a developer apparatus for electrophotographic printing. More specifically, the invention relates to a back up roll as part of a scavengeless development process.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the areas on the latent image which are charged relative to the development bias. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor relative to the developer roll will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

An important variation to the general principle of development is the concept of "scavengeless" development. The purpose and function of scavengeless development are described more fully in, for example, U.S. Pat. No. 4,868,600 to Hays et al. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography.

A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, i.e., the nip between the donor roll and the photoreceptor, are the wires forming the electrode structure. It should be appreciated that the electrode structure may have forms other than wires. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single-component developer material. In a single component scavengeless development, the donor roll and the electrode structure create a toner powder cloud in the same manner as the above-described scavengeless development, but instead of using carrier and toner, only toner is used.

In an electrostatographic imaging system using a photoreceptor belt, the belt is entrained by a drive roller around a plurality of backup rollers as it is conveyed past the various stations in the printing process, the backup rollers press from the inside of the belt to minimize any undesirable movement of the belt. In order for good printing quality to result, the belt must be sufficiently taut at the various stations in the printing process so that such undesirable movement does not occur. In addition, it is desirable that the belt does not slacken or slip during operation (particularly at the imaging and developing stations), and that the rollers do not damage the belt material. It is also desirable that the rollers be lightweight so that the time and power required to start and stop the movement of the belt is reduced.

To obtain proper developability and resultant print quality from the copy machine it is particularly important that the photoreceptor belt be free from wrinkles and dents at the development zone. Because the gap between the donor roll and the photoreceptor belt is so small and because in single component scavengeless development, magnetic carrier particles are not used on the donor roll to assist transfer, the absence of wrinkles and dents is even more critical in scavengeless development. This invention is directed to minimizing wrinkles and dents.

The following disclosures may be relevant to various aspects of the present invention:

U.S. Pat. No. 5,229,813
Patentee: Cherian
Issue Date Jul. 20, 1993
U.S. Pat. No. 5,177,538
Patentee: Mammino et al.
Issue Date Jan. 5, 1993
U.S. Pat. No. 5,087,946
Patentee: Dalai et al.
Issue Date: Feb. 11, 1992
U.S. Pat. No. 4,868,600
Patentee: Hays et al
Issue Date: Sep. 19, 1989
U.S. No. 4,841,613
Patentee: Beery
Issue Date: Jun. 27, 1989
U.S. Pat No. 4,583,272
Patentee: Keller
Issue Date: Apr. 22, 1986
U.S. Pat. No. 4,501,646
Patentee: Herbert
Issue Date: Feb. 26, 1985
U.S. Pat.No. 4,440,295
Patentee: Blackwood-Murray et al.
Issue Date: Apr. 3, 1984
U.S. Pat. No. 4,372,247
Patentee: Calabrese
Issue Date: Feb. 8, 1983
U.S. Pat. No. 4,279,496
Patentee: Silverberg
Issue Date: Jul. 21, 1981
U.S. Pat. No. 4,230,406
Patentee: Klett
Issue Date: Oct. 28, 1980
U.S. Pat. No. 4,186,162
Patentee: Daley
Issue Date: Jan. 29, 1980
U.S. Pat. No. 4,067,782
Patentee: Bailey et al.
Issue Date: Jan. 10, 1978
U.S. Pat. No. 4,034,709
Patentee: Fraser et al.
Issue Date: Jul. 12, 1977
U.S. Pat. No. 3,876,510
Patentee: Wallin et al.
Issue Date: Apr. 8, 1975
U.S. Pat. No. 3,844,906
Patentee: Bailey et al.
Issue Date Oct. 29, 1974.

The relevant portions of the foregoing disclosures may be briefly summarized as follows:

U.S. Pat. No. 3,844,906 discloses a process for maintaining a continuous and stable aqueous nickel sulfamate electroforming solution adapted to form a relatively thin, ductile, seamless nickel belt by electrolytically depositing nickel from the solution onto a support mandrel and thereafter recovering the nickel belt by cooling the nickel coated mandrel effecting a parting of the belt from the mandrel due to different thermal coefficients of expansion.

U.S. Pat. No. 3,876,510 discloses a method and apparatus for forming a relatively thin, flexible electrically conductive endless belt on a support mandrel wherein the mandrel and belt exhibit different temperature coefficients of expansion. The method includes the steps of preheating the mandrel, positioning the mandrel in an electrolytic cell, rotating the mandrel in the cell, withdrawing the belt and mandrel and cooling the belt and mandrel.

U.S. Pat. No. 4,034,709 discloses an apparatus which renders a latent image visible by depositing developer material thereon. The apparatus includes a tubular member having a styrene-butadiene layer coated on a nonmagnetic roll. Magnets are disposed interiorly of the tubular member to attract developer material thereto.

U.S. Pat. No. 4,067,782 discloses a process for nickel plating a cylindrically shaped hollow core mandrel suitable for chromium plating for use in an electroforming process for the production of seamless nickel xerographic belts. The process includes providing a hollow core of aluminum, anodizing the core, and nickel plating the anodized core member.

U.S. Pat. No. 4,186,162 discloses a method of making a business machine platen core wherein a cylindrical body including a hollow tube extends coaxially thereof and is encapsulated with an insulating foam with a pair of opposed plugs inserted in each end thereof.

U.S. Pat. No. 4,230,406 discloses an apparatus which cleans particles from a photoconductive member arranged to advance along a predetermined path. When the photoconductive member is stationary, the particle cleaner and the photoconductive member are spaced from one another. The photoconductive member is deflected into engagement with the particle cleaner in response to the photoconductive member advancing along the predetermined path.

U.S. Pat. No. 4,186,162 discloses an apparatus in which a belt is supported by a fixed mounting and a movable mounting. In the operative position, the fixed mounting maintains at least a portion of the belt to the operative position. In order to remove the belt, the movable mounting is returned to the inoperative position with the belt being undeflected.

U.S. Pat. No. 4,372,247 discloses a fusing apparatus for fixing toner material to a copy sheet. The apparatus comprises a pair of parallel, cold pressure fixing rollers. Each of the rollers includes a cylindrical metal tube open at both ends. A cured elastomer occupies the volume enclosed by and bonded to the elastomer. The shaft is concentric with the tube.

U.S. Pat. No. 4,440,295 discloses an idler roller particularly for conveyor belt support and comprises a prefabricated core member about which is molded an abrasion and impact resistant load bearing synthetic plastic shell. The shell includes a tubular load bearing wall and integral side walls for the accommodation of bearings which receive the idler shaft.

U.S. Pat. No. 4,501,646 discloses an electroforming process comprising providing a core mandrel having an electrically conductive, adhesive outer surface, a segmented cross section of less than 1.8 square inches. Stress-strain hysteresis is used to impart a stress on the cooled coating formed on the mandrel to permanently deform the coating and thereby permit removal of the coating from the mandrel.

U.S. Pat. No. 4,583,272 discloses a platen for printers. The platen has a tubular resilient sleeve with an outer cylindrical circumferential surface. A shaft is contained within the sleeve. The shaft has portions exposed at the ends of the sleeve which are concentrically aligned with the sleeve's outer surface.

U.S. Pat. No. 4,841,613 discloses roll type presses or pressure developers which include a pressure roll in which one of the load bearing and transmitting material is a carbon fiber and epoxy composite. The pressure roll has an outer metal tubular sleeve which is filled or substantially filled with a composite material.

U.S. Pat. No. 4,868,600 discloses a scavengeless development system in which toner detachment from a donor and the concomitant generation of a controlled powder cloud is obtained by AC electrical fields supplied by self-spaced electrode structures positioned within the development nip. The electrode structure is placed in close proximity to the toned donor within the gap between toned donor and image receiver, self-spacing being effected via the toner on the donor.

U.S. Pat. No. 5,087,946 discloses a fuser roll including a hollow cylinder having a relatively thin wall. The cylinder is a plastic composition reinforced with a conductive fiber filler. The plastic composition has a resistivity between 0.5 and 0.05 ohm cm. The cylinder has an inside and an outside surface and encloses ambient air.

U.S. Pat. No. 5,177,538 discloses a donor roll formed by mixing resin particles with conductive particles and subsequently extruding or centrifugally casting the mixture into a cylindrical shell. The shell is cut to the desired length and journals are attached to the end of the shell.

U.S. Pat. No. 5,229,813 discloses a backup roller assembly having a plurality of rollers for applying pressure to an inside surface of a photoreceptor web. A process is also disclosed for making such backup rollers wherein a thin walled tube is extruded from a metallic or polymeric material. After extrusion, the tubing is cut to a desired length and filled with a filler. Journals are attached at each end of the tube by the adhesion of the foam.

According to the present invention, there is provided an apparatus for developing a latent image recorded in a surface of a flexible photoconductive member. The apparatus includes a developer unit having a developer roll and a backing member. The roll is positioned opposed from the surface of the flexible photoconductive member and is used for developing the latent image with developer material. The backing member has an arcuate surface in engagement with a surface of the flexible photoconductive member opposed from the surface having the latent image recorded thereon. The flexible photoconductive member is wrapped about at least a portion of the arcuate surface of the backing member to form a negative wrap angle opposed from the developer unit. The centerpoint of the developer roll, the centerpoint of the backing member and the centerpoint of the arcuate surface are colinear.

According to the present invention, there is also provided a backing member adapted to support a flexible photoconductive member having a latent image recorded on a surface developed by a developer unit positioned opposed from the surface. The backing member includes a first arcuate portion and a second arcuate portion spaced from and substantially parallel to the first arcuate portion. The backing member further includes a third arcuate portion connecting the first arcuate portion with the second arcuate portion. The backing member also includes a fourth arcuate portion connecting the first arcuate portion with the second arcuate portion. The first arcuate portion is in contact with a surface of the flexible photoconductive member opposed from the surface having the latent image recorded thereon.

According to the present invention, there is further provided an electrophotographic printing machine of the type adapted to develop with toner an electrostatic latent image recorded on a photoconductive member. The printing machine includes a developer unit having a developer roll and a backing member. The roll is positioned opposed from the surface of the flexible photoconductive member and is used for developing the latent image with developer material. The backing member has an arcuate surface in engagement with a surface of the flexible photoconductive member opposed from the surface having the latent image recorded thereon. The flexible photoconductive member is wrapped about at least a portion of the arcuate surface of the backing member to form a negative wrap angle opposed from the developer unit. The centerpoint of the developer roll, the centerpoint of the backing member and the centerpoint of the arcuate surface are colinear.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
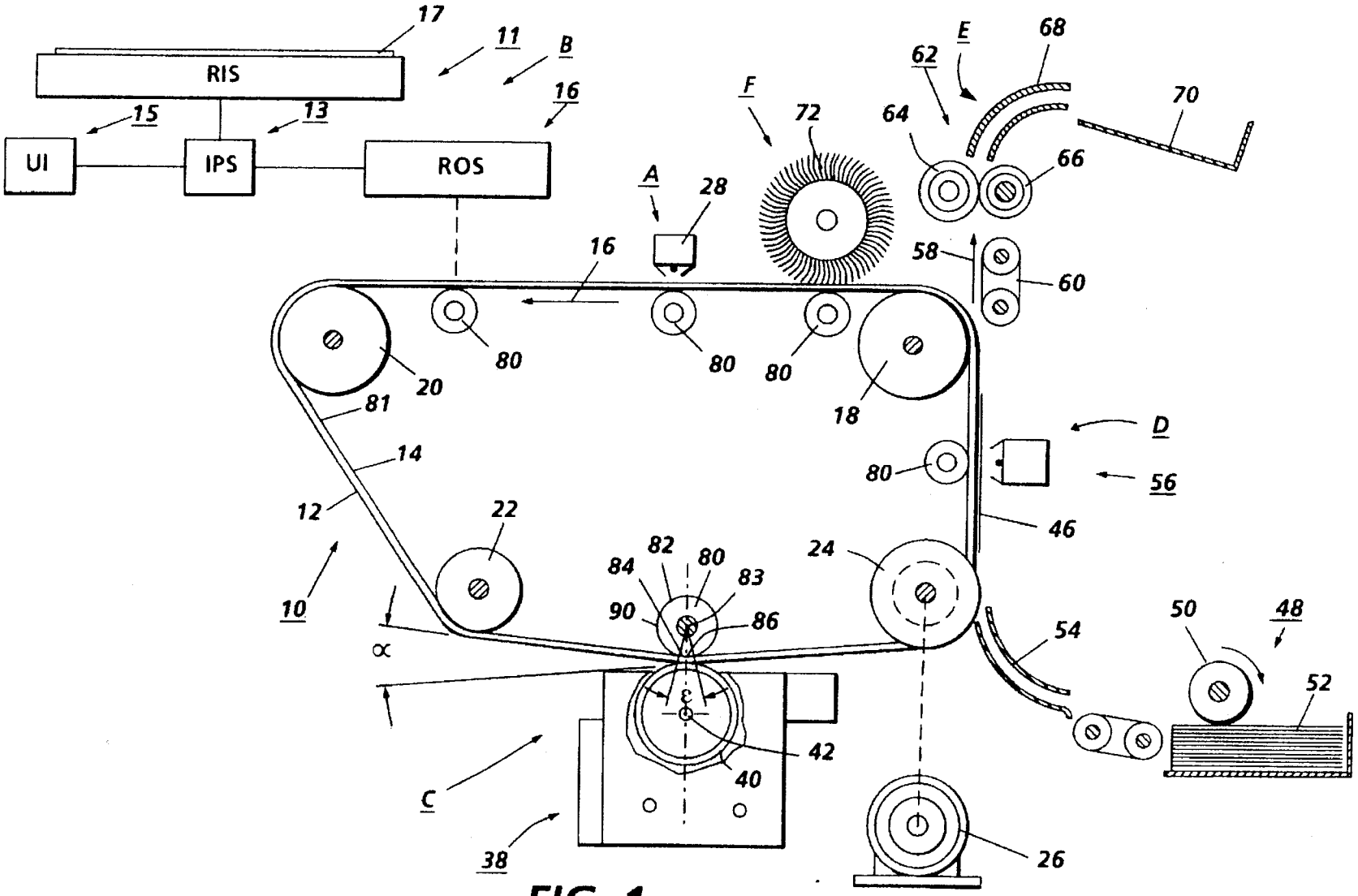
FIG. 1 is a schematic view of a an electrophotographic printing machine incorporating the back up roll of the present invention therein.

Turning now to FIG. 1, the electrophotographic printing machine employs a belt 10 having a photoconductive surface 12 responsive to infrared and/or visible light deposited on a conductive substrate 14. Preferably, photoconductive surface 12 is made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20 and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, an original document 17 is positioned on a raster input scanner (RIS), indicated generally by the reference numeral 11. The RIS contains document illumination lamps, optics, a mechanical scanning drive, and a charge coupled device (CCD array). The RIS captures the entire original document and converts it to a series of raster scan lines and (for color printing) measures a set of primary color densities, i.e., red, green and blue densities at each point of the original document. This information is transmitted to an image processing system (IPS), indicated generally by the reference numeral 13. IPS 13 is the control electronics which prepare and manage the image data flow to the raster output scanner (ROS), indicated generally by the reference numeral 16. A user interface (UI), indicated generally by the reference numeral 14, is in communication with the IPS. The UI enables the operator to control the various operator adjustable functions. The output signal from the UI is transmitted to IPS 13. The signal corresponding to the desired image is transmitted from IPS 13 to ROS 16, which creates the output copy image. ROS 16 lays out the image in a series of horizontal scan lines with each line having a specified number of pixels per inch. The ROS includes a laser having a rotating polygon mirror block associated therewith. The ROS exposes the charged photoconductive surface of the printer.

At development station C, a developer unit, indicated generally by the reference numeral 38 including a developer roll 40 having a centerpoint 42, transports a developer material into contact with the electrostatic latent image recorded on photoconductive surface 12. Toner particles are attracted to the electrostatic latent image forming a toner powder image on photoconductive surface 12 of belt 10 so as to develop the electrostatic latent image. A plurality of developer units (containing, for example, cyan, magenta and yellow developer) would be used for color developing.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the upper most sheet of a stack of sheets 52. Feed roll 50 rotates to advance the upper most sheet from stack 50 into chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

At each of the stations along the photoreceptor belt (stations A–D and F) can be located a backup roller 80 on inside periphery 81 of the belt 10 for pressing against the inside surface of the belt 10. The backup rollers 80 can each be different in shape and configuration or can all be identical. As can be seen in FIG. 1, backup rollers 80 are shown for pressing against the photoreceptor belt at exposure station B, for applying pressure at developer station C, and for applying pressure against the inside of photoreceptor 10 at cleaning station F. Backup rollers 80 are shown at charging station A and transfer station D. Each backup roller 80 applies pressure to the inside of the photoreceptor belt at the respective locations to minimize belt movement (vibrations, slackening, etc.). It should be noted that in a color printer more than one backup roller 80 could be used in place of the backup roller 80 at the developer station C. In color printing, four developing stations may be used for the application of four different colors to the photoreceptor belt. Thus, a backup roller 80 may be used at each developer station. For developer stations having more than one developer roll, a backup roller corresponding to each developer roll may be used. Also a backup roller 80 may be used as an encoder roller located adjacent drive roller 24.

The foregoing description is sufficient for purposes of the present application to illustrate the general operation of an exemplary electrophotographic printing machine incorporating the features of the present invention therein.

As earlier stated, to obtain proper developability and resultant print quality from the copy machine, it is particularly important that the photoreceptor belt be free from wrinkles and dents at the development zone.

Referring to FIG. 1, to assure that the belt 10 is free from wrinkles and dents at the development station C, the applicants have found that the positioning of a backup roll 90 at location as shown adjacent the development station C is preferred. The belt 10 is guided about the periphery 82 of the roll 90. Backup roll 90 includes centerpoint 83 about which backup roll 90 rotates.

The belt 10 contacts the roll 90 with a negative wrap angle $\alpha$ as shown in FIG. 1. The belt 10 contacts the roll at surface 84 on the periphery 82 of the roll 90. The negative wrap angle $\alpha$ defines that angle formed by the actual position of the belt 10 prior to approaching roll 90 at development station C and the approaching position if the belt 10 were in a straight line with the belt after it leaves member 80 at development station C. The belt 10, thus, contacts or wraps around backup roll 90 with the contact described by an angle $\epsilon$ about the centerline of belt 10.

As shown in FIG. 1, the periphery 82 of the backup roll 80 has an arcuate engagement surface 84 in engagement with a surface of the flexible photoconductive belt 10. The surface 84 defines a centerpoint 86 thereof. The centerpoint 42 of the developer roll 40, the centerpoint 83 of the backing member 80 and the centerpoint 86 of the arcuate surface 84 are colinear.

Figure 8:
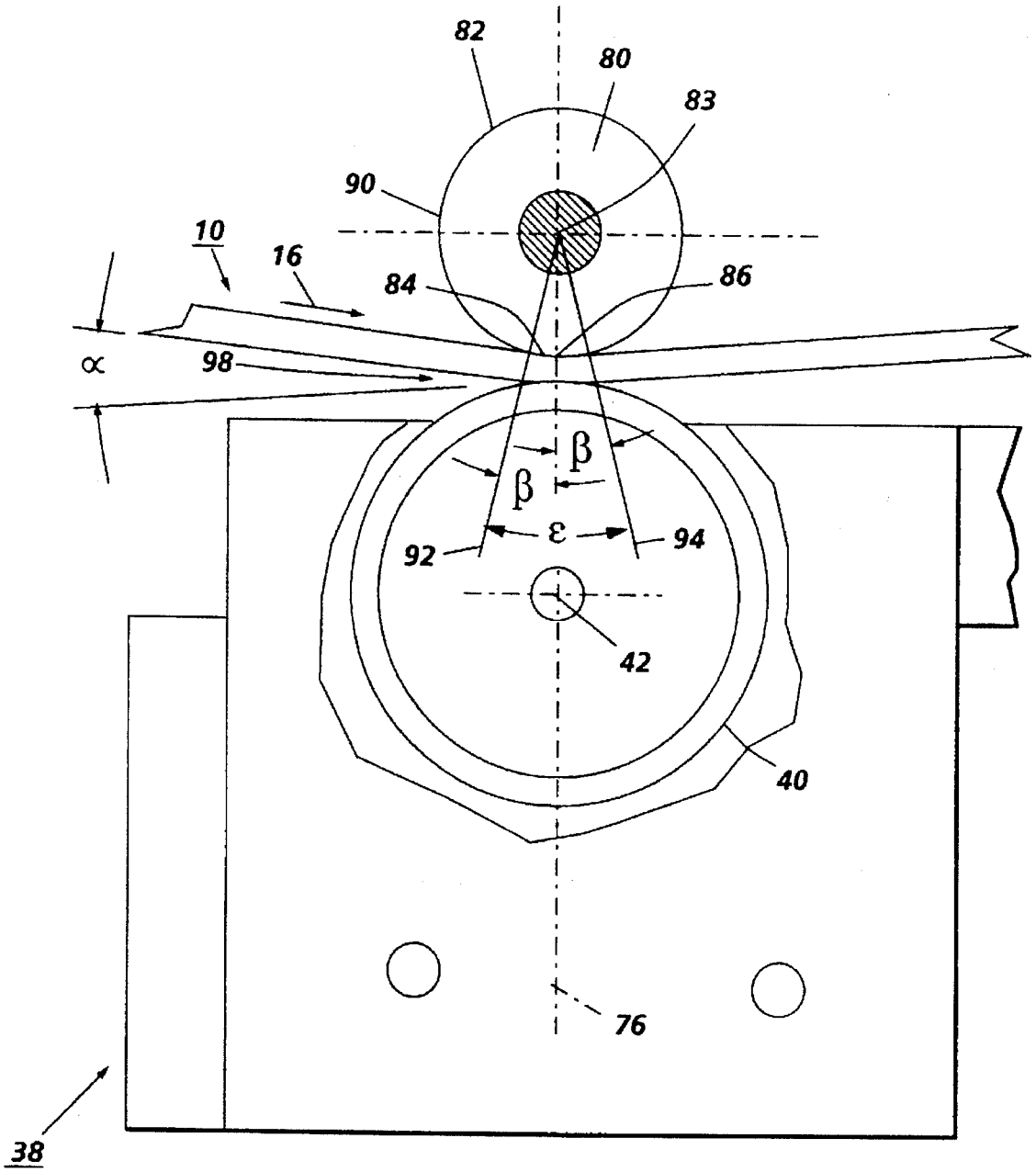
FIG. 8 is an elevational view of a back up roll of the present invention shown in position adjacent the developer unit.

Referring now to FIG. 8, the back up roll 90 is shown in greater detail in contact with the belt 10 at the development station C. The back up roll begins its contact with the belt 10 at line 92 and ends its contact with the belt 10 at line 94 as the belt traverses in direction of arrow 16. The angle $\epsilon$ thus defines the angle between lines 92 and 94.

To assure that the backup roll 90 will most effectively smooth out the wrinkles of the belt while the belt 10 in the development nip 98, the area in which development occurs, the developer roll 40 is preferably positioned centered under the arcuate engagement surface 84 of the back up roll 90. The centerpoint 83 of the back up roll 90, the centerpoint 8 of the arcuate engagement surface 84 of the backup roll 90, and the centerpoint 42 of the development roll 40 are colinear and form a line 96. The line 96 divides the angle $\epsilon$ into two equal angles $\beta$.

Referring again to FIG. 1, while values of $\alpha$ greater than 1.0 degrees have been found to be sufficient, the value of $\alpha$ should be preferably more than about 2.0 degrees. The value of angle $\epsilon$ can be determined by the following formula for values of $\alpha$ of less than 90 degrees:

$$\epsilon=\alpha$$

While the use of negative wrap at development station C is particularly beneficial, it should be readily apparent that the use of negative wrap at charging station A, exposure station B, transfer station D, fusing station E and cleaning station F, may likewise be beneficial. The use of negative wrap is beneficial regardless of the shape of the backup roll 80. Nonetheless, to avoid damaging the belt material, the backup roll 80 preferably has an arcuate contact with the belt 10.

As earlier stated in order for good printing quality to result, the belt must be sufficiently taut at the various stations, not slacken or slip in the printing process. Back up rolls are frequently used to keep the belt taut at the stations. The rolls must be made with sufficient precision, in particular to have minimum runout, to avoid slipping and slackening of the belt. Further, the rollers need be accurate to avoid damaging the belt material. It is also desirable that the rollers be lightweight so that the time and power required to start and stop the movement of the belt is reduced.

Various materials, shapes, and manufacturing methods are available to manufacture light weight, accurate backing rollers. U.S. Pat. No. 5,229,813 discloses a composite backup roller. Electroforming of the backup rolls, described below, offers an alternate light weight, accurate backup roll.

The fabrication of hollow articles having a large cross-sectional area may be accomplished by an electroforming process. For example, electrically conductive, flexible, seamless belts for use in an electrostatographic apparatus can be fabricated by electrodepositing a metal onto a cylindrically shaped mandrel which is suspended in an electrolytic bath.

A suitable electroforming process for electroforming such belts is described, for example, in U.S. Pat. No. 4,067,782, issued Jan. 10, 1978, incorporated herein by reference. A somewhat similar process for electroforming smaller components is described, for example, in U.S. Pat. No. 4,501,646, issued Feb. 26, 1985, incorporated herein by reference. This process for smaller components is suitable for manufacture of electroformed nickel backup rolls.

Figure 2:
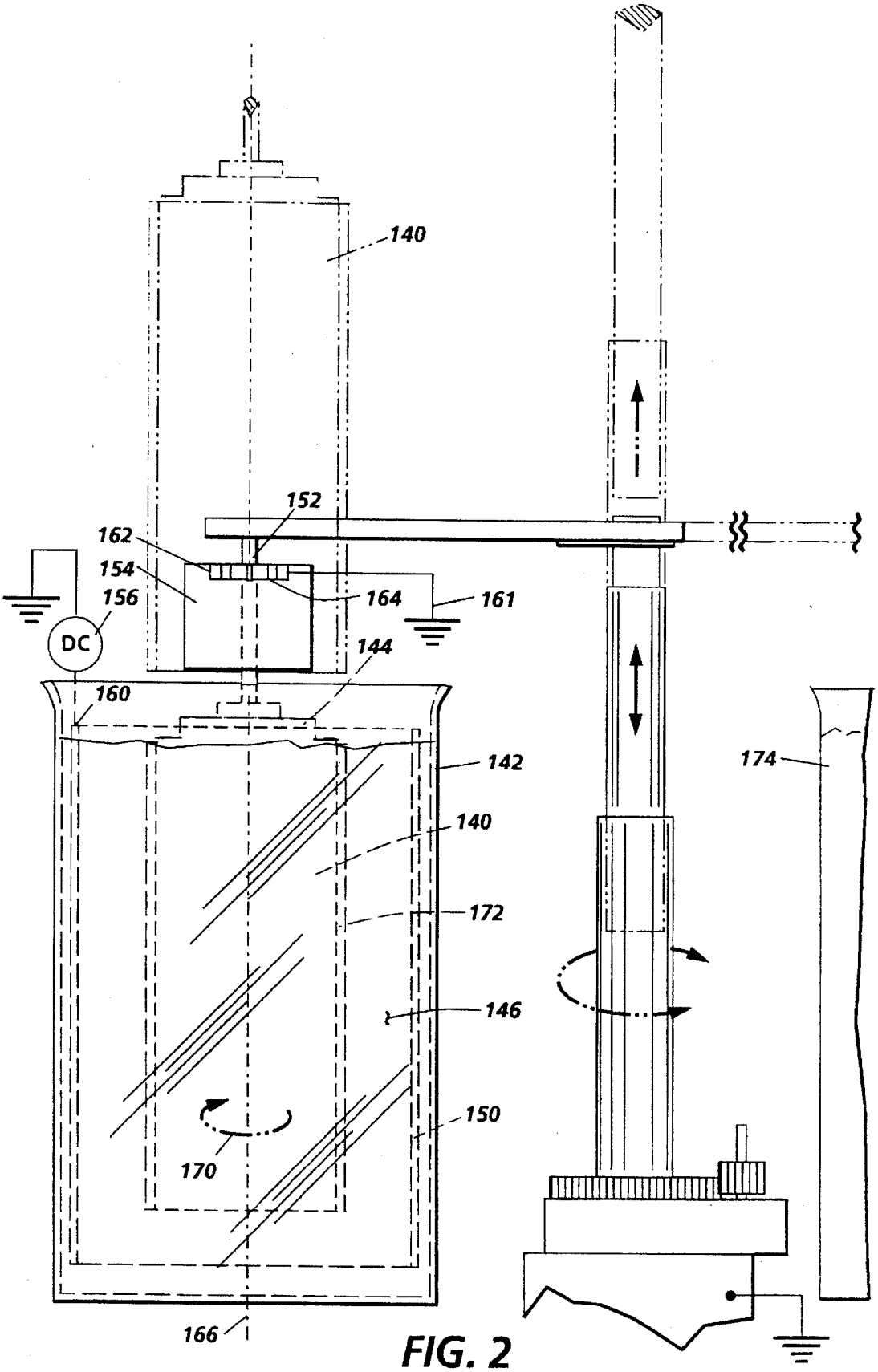
FIG. 2 is a perspective view of an apparatus which may be utilized to fabricate back up rolls of the present invention.

The electroforming process of this invention may be conducted in any suitable electroforming device. For example, referring to FIG. 2, a solid cylindrically shaped mandrel 140 may be suspended vertically in an electroplating tank 142. The mandrel 140 is constructed of electrically conductive material that is compatible with a metal plating solution 146. For example, the mandrel 140 may be made of stainless steel. Top edge 144 of the mandrel 140 may be masked off with a suitable non-conductive material, such as wax to prevent deposition. The mandrel 140 may be of any suitable cross-section including circular, rectangular, triangular and the like. The electroplating tank 142 is filled with the plating solution 146 and the temperature of the plating solution 146 is maintained at the desired temperature. The electroplating tank 142 can contain an annular shaped anode basket 150 which surrounds the mandrel 140 and which is filled with metal chips. The anode basket 150 is disposed in axial alignment with the mandrel 140.

The mandrel 140 is connected to a rotatable drive shaft 152 driven by a motor 154. The drive shaft 152 and motor 154 may be supported by suitable support members. Either the mandrel 140 or the support for the electroplating tank 142 may be vertically and horizontally movable to allow the mandrel 140 to be moved into and out of the electroplating solution 146. Electroplating current can be supplied to the electroplating tank 142 from a suitable DC source 156. Positive end 160 of the DC source 156 can be connected to the anode basket 150 and negative end 161 of the DC source 156 connected to a brush 162 and a brush/split ring 164 arrangement on the drive shaft 152 which supports and drives the mandrel 140. The electroplating current passes from the DC source 156 to the anode basket 150, to the plating solution 146, the mandrel 140, the drive shaft 152, the split ring 164, the brush 162, and back to the DC source 156. In operation, the mandrel 140 is lowered into the electroplating tank 142 and continuously rotated about its vertical axis 166 in the direction of arrow 170. It should be appreciated that the mandrel 140 may be likewise rotated in the opposite direction with similar results. As the mandrel 140 rotates, a layer 172 of electroformed metal is deposited on its outer surface.

When the layer 172 of deposited metal has reached the desired thickness, the mandrel 140 is removed from the electroplating tank 142 and immersed in a cold water bath 174. The temperature of the cold water bath 174 should be between about 80° F. and about 33° F. When the mandrel 140 is immersed in the cold water bath 174, the deposited metal 172 is cooled prior to any significant cooling and contracting of the solid mandrel 140 to impart an internal stress of between about 40,000 psi and about 80,000 psi to the deposited metal 172. Since the metal 172 cannot contract and is selected to have a stress-strain hysteresis of at least about 0.00015 in/in, it is permanently deformed so that after the core mandrel 140 is cooled and contracted, the deposited metal article 172 may be removed from the mandrel 140. The deposited metal article 172 does not adhere to the mandrel 140 since the mandrel 140 is selected from a passive material. Consequently, as the mandrel 140 shrinks after permanent deformation of the deposited metal 172, the deposited metal article 172 may be readily slipped off the mandrel 140. The deposited metal article 172 upon leaving the mandrel 140 has the appearance of thin walled tube 172. The thin walled tube 172 may serve as a portion of the back up roll 80 (see FIG. 1).

It should be readily appreciated that a typical electrolytic cell for depositing metals such as nickel may likewise comprise a tank containing a rotary drive means including a mandrel supporting drive hub centrally mounted thereon (not shown). The drive means may also provide a low resistance conductive element for conducting a relatively high amperage electrical current between the mandrel and a power supply. The cell is adapted to draw, for example, a peak current of about 3,000 amperes DC at a potential of about 18 volts. Thus, the mandrel comprises the cathode of the cell. An anode electrode for the electrolytic cell comprises an annular shaped basket containing metallic nickel which replenishes the nickel electrodeposited out of the solution. The nickel used for the anode comprises sulfur depolarized nickel. Suitable sulfur depolarized nickel is available under the tradenames, "SD" Electrolytic Nickel and "S" Nickel Rounds from International Nickel Co. Non sulfur depolarized nickel can also be used such as carbonyl nickel, electrolytic nickel and the like. The nickel may be in any suitable form or configuration. Typical shapes include buttons, chips, squares, strips and the like. The basket is supported within the cell by an annular shaped basket support member which also supports an electroforming solution distributor manifold or sparger which is adapted to introduce electroforming solution to the cell and effect agitation thereof. A relatively high amperage current path within the basket is provided through a contact terminal which is attached to a current supply bus bar.

The electroformed thin wall tube 172 may be combined with any other suitable components to form the backup roll 80. The electroformed thin wall tube 172 may be made from any suitable plateable material such as nickel as earlier described. The electroformed thin wall tube 172 may have a circular cross section or a cross section of any suitable shape.

Figure 3:
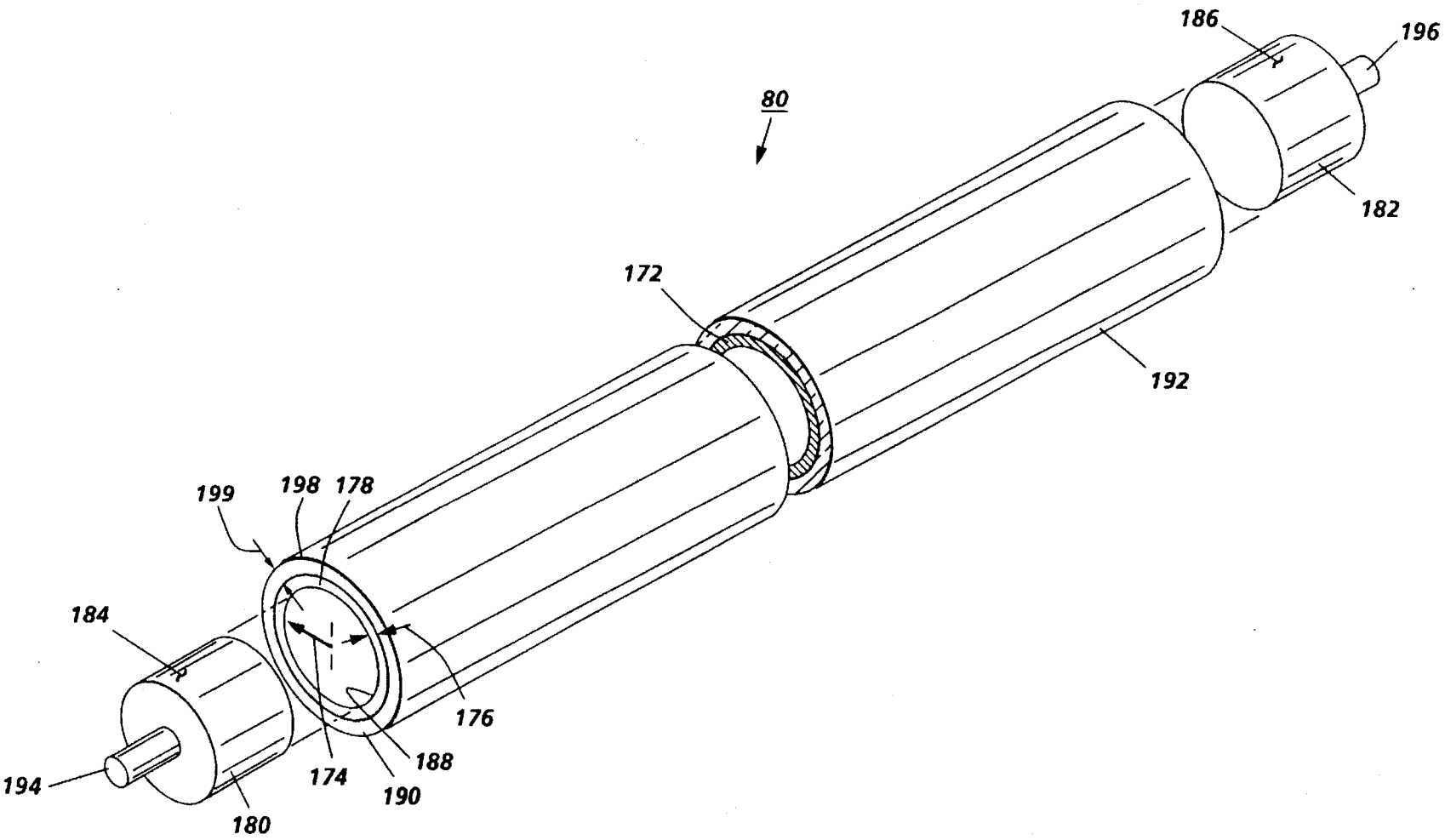
FIG. 3 is a perspective view of an embodiment of a back up roll of the present invention having separable end caps.

According to the present invention, and referring to FIG. 3, the backup roll 80 is shown utilizing the electroformed thin wall tube 172. The thin wall tube 172 has an outside diameter 174 sufficiently large to provide sufficient strength for the backup roll 80. The diameter 174 of the thin wall tube 172 typically is from 10 to 60 mm. with 25 mm. being preferred. The tube 172 has a wall thickness 176 sufficiently large to provide the backup roll 80 with sufficient strength. The thickness 176 of the backup roll 80 preferably ranges from 0.002 to 0.010 inches. The electroforming process provides for very accurate thin walled tubes 172. As such, the tube 172 has an outer surface 178 which is typically round within 0.0005 inches total indicator readout. To provide mounting for the backup roll 80, first and second plugs 180 and 182, respectively, are provided. Plugs 180 and 182, respectively, have cylindrical peripheries 184 and 186, respectively, which interferencely fit into inner surface 188 of the tube 172. The first plug 180 fits into a first end 190 of the tube 172, while the second plug 182 fits into a second end 192 of the tube 172. First and second projectiles 194 and 196, respectively, extend outwardly from first and second plugs 180 and 182, respectively. The projectiles 194 and 196 provide a feature for interconnecting the backup roll 80 to the printing machine. To provide a rotatable roll 80, the projectiles 194 and 196 are preferably cylindrical and concentric with the peripheries 184 and 186, respectively, of the plugs 180 and 182. To provide electrically insulative properties to the roll 80, the tube 172 includes a ceramic coating 198 which may be applied to the outer surface 178 of the tube 172 by any suitable process such as plasma spraying or the chemical vapor method. The ceramic coating 198 has a thickness 199 of preferably 0.0004 to 0.0020 inches.

Figure 4:
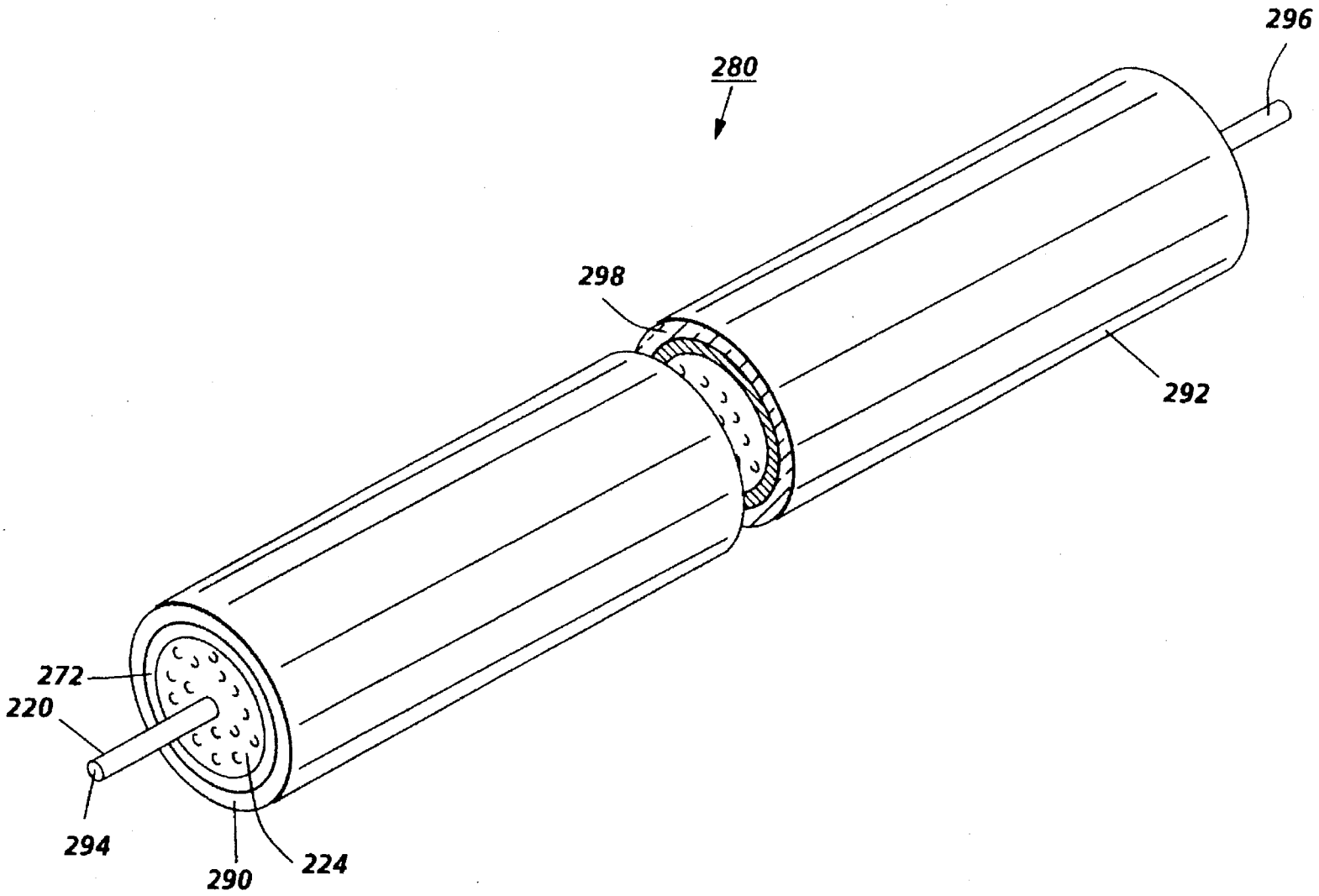
FIG. 4 is a perspective view of another embodiment of a back up roll of the present invention having a centrally located shaft.

An alternative design of a backup roll utilizing the present invention is shown in backup roll 280 as shown in FIG. 4. The backup roll 280 includes thin wall tube 272 which is cylindrical in shape and similar to tube 172 of FIG. 3. Again referring to FIG. 4, the tube 272 preferably is coated with a ceramic coating 298 to provide insulative properties to the roll 280. A shaft 220, preferably having a cylindrical cross section and made of suitable durable material such as a metal or a plastic, is located within the tube 272. The shaft 220 extends outwardly from first end 290 and second end 292 of the roll 280. Any suitable material may be used to position the shaft 220 concentrically within the tube 272, but preferably, foam 224 is used to position the shaft 220. Any suitable foam material 224 may be used, but preferably a two component urethane material is used. The shaft 220 is properly positioned within the tube 272, after which the mixed urethane material is metered into the tubing and permitted to cure therewithin. First and second ends 294 and 296 of the shaft 220 extend outwardly beyond first end 290 and second end 292, respectively, of the roll 280. The ends 294 and 296 provide a feature for supporting the backup roll 280.

Figure 5:
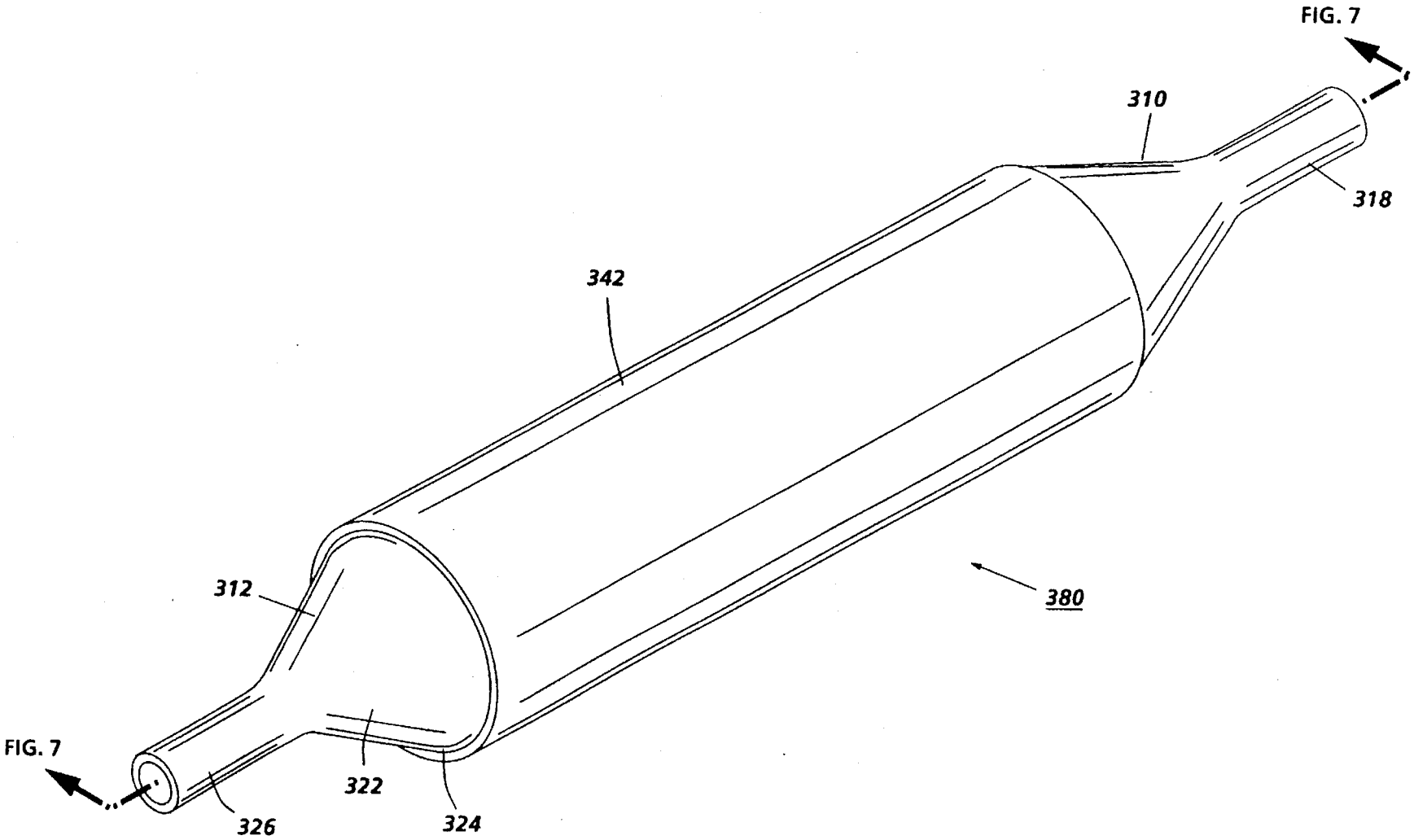
FIG. 5 is a perspective view of another embodiment of a back up roll of the present invention having a telescopic two piece shaft.
Figure 6:
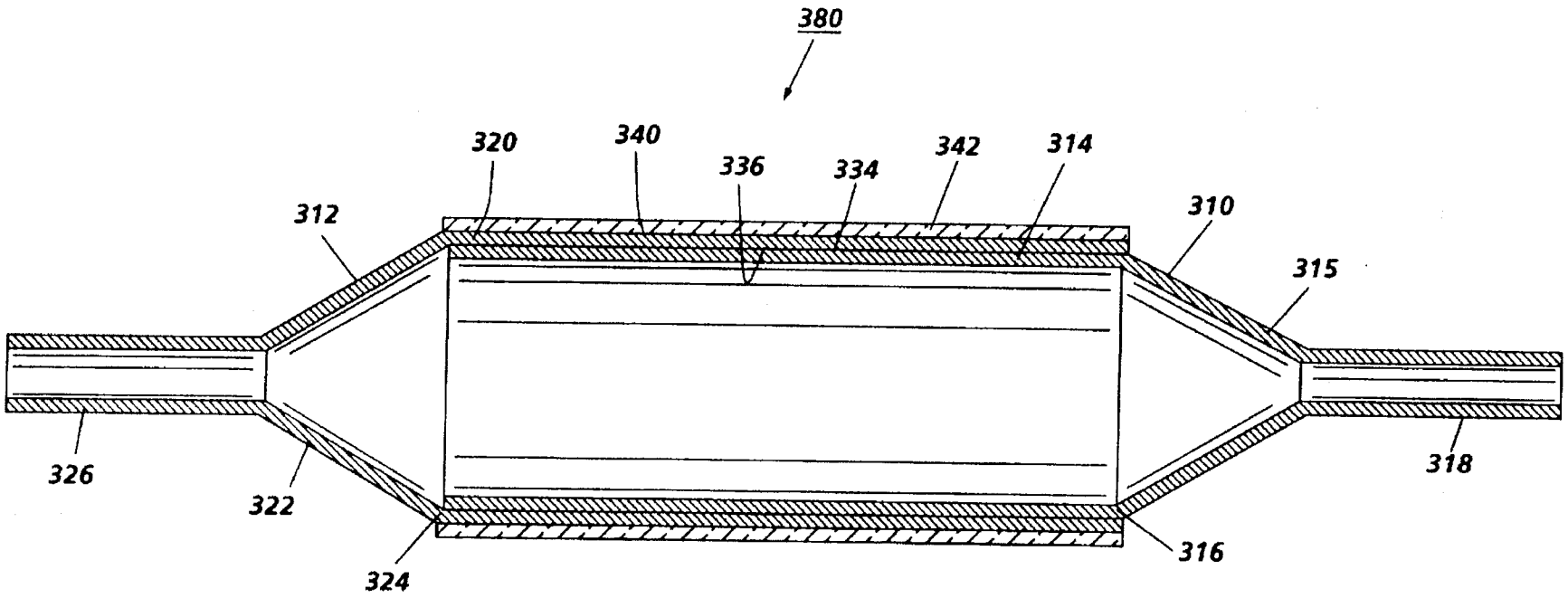
FIG. 6 is a cross sectional view through section 6—6 of FIG. 5.

A further embodiment of the present invention is shown in FIGS. 5 and 6. First referring to FIG. 5, backing member 380 includes a first thin wall tube 310 which telescopically slidingly fits within a second thin wall tube 312. The first tube 310 includes a large cylindrical portion 314, a conical portion 315 extending from a first end 316 of the large cylindrical portion 314 and a small cylindrical portion 318 extending outwardly from the conical portion 315. The second tube 312 includes a large cylindrical tubular portion 320, a second conical portion 322 extending outwardly from a first end 324 of the large cylindrical portion 320, and a small cylindrical portion 326 extending outwardly from the second conical portion 322.

Now referring to FIG. 6, the large cylindrical portion 314 of the first tube 310 includes a periphery 334 which slidably fits within inner surface 336 of the large cylindrical portion 320 of the second portion 312. A simple, two piece backing member 380 is thus provided from the first tube 310 and second tube 312. Small cylindrical portions 318 and 326, preferably, are concentric with the large cylindrical portions 314 and 320, respectively. The backing member 380 is thereby rotatable around the stems 318 and 326. The small cylindrical portions 318 and 326 also provide support for the backing member 380. To provide electrically insulative properties to the roll 380, an outer surface 340 of large cylindrical portion 320 includes a ceramic coating 342.

Figure 7:
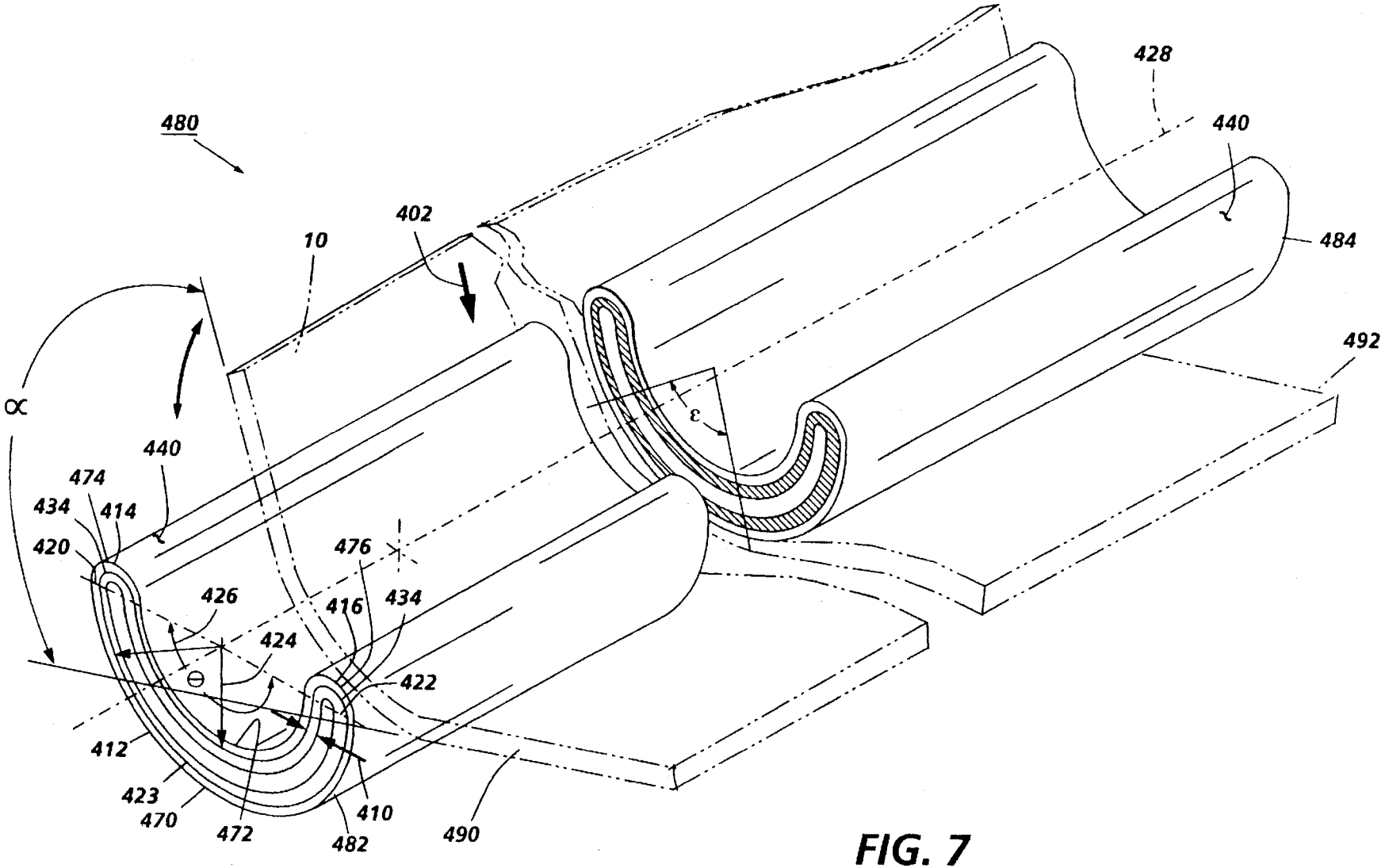
FIG. 7 is a perspective view of another embodiment of a back up roll of the present invention having a non-circular cross section.

A further embodiment of the present invention is shown in the backing member 480 of FIG. 7. This embodiment is particularly well suited to be placed in an electrophotographic printing machine where there is limited space around the development nip. A backing member with spaced apart parallel arcuate portions provides a strong durable backing member that may be placed in a machine where the area around the developer unit has limited space.

While the backing members 80, 280 and 380 of FIGS. 3, 4 and 5, respectively, may either rotate or not rotate, the backing member 480 is intended to not rotate. Photoreceptive belt 10 is shown moving about backing member 480 in the direction of arrow 402. It should be readily apparent that the belt 10 may alternatively move in the opposite direction with proper rearrangement of components of the machine. The belt 10 has a negative wrap angle $\alpha$.

The backing member 480 has an elongated shape with an arcuate cross section. The arcuate cross section is hollow with a thickness 410 sufficient to provide adequate strength to the backing member 480, but preferably, has a thickness of 0.002 to 0.010 inches. The backing member 480 has a central portion 412 having the shape of a portion of a cylinder, a first end portion 414 having a semi-circular cross section and a second end portion 416 also having a semi-circular cross section. The first and second end portions 414 and 416, respectively, extend outwardly beyond first end 420 and second end 422 of the central portion 412 of the backing member 480. A periphery 423 of the central portion 412 has an inner radius 424 and an outer radius 426 extending from centerline 428 of the backing member 480. A periphery 434 of the end portions 414 and 416 blends at ends 420 and 422, respectively, with the periphery 423 of the central portion 412. The central portion 412 thus includes a first arcuate portion 470 in contact with the belt 10 and a second arcuate portion 472 spaced from and parallel to the first arcuate portion 470. The first and second end portions 414 and 416, respectively, form third and fourth arcuate portions 474 and 476, respectively. The belt 10 is guided about the periphery 423 of the member 480. The belt 10 enters and exits the backup member 480, forming the negative wrap angle $\alpha$. The belt 10, as earlier described, contacts backup member 480 at an angle about centerline 428 of belt 10 of angle $\epsilon$. The value of $\alpha$ should be preferably more than 2.0 degrees. The value of angle $\epsilon$ can be determined by the following formula for values of $\alpha$ of less than 90 degrees:

$$\epsilon=\alpha$$

To provide proper contact of the belt 10 to the backup member 480, angle $\theta$ defining the arcuate central portion 412 of the member 480 should be greater than or equal to the value of angle $\epsilon$. Any value of the outer radius 426 which provides for proper contact of the belt 10 against the member 480 is acceptable, but preferably, the outer radius 426 is 5 to 30 mm. To provide electrically insulative properties to the member 480, a ceramic coating 440 may be preferably applied to the periphery 423 of the central portion 412 of the member 480 at least where the belt contacts the member 480. It should be readily apparent that ceramic coating 440 may extend into other portions of the periphery 423 and into the periphery 434 as well. To provide a surface with which to mount the member 480 to the machine, the member 480 may have first and second mounting portions 482 and 484, respectively, which extend past first and second ends 490 and 492, respectively, of the belt 10.

The back up roll of the present invention with the back up roll centerpoint, the development roll centerpoint and the backup roll/belt contact area centerpoint all being colinear provides for a wrinkle free belt at the development nip. A wrinkle free belt at the development nip improves copy quality.

A backing member with spaced apart parallel arcuate portions provides a strong durable backing member that may be placed in a machine where the area around the developer unit has limited space.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. An apparatus for developing a latent image recorded on a surface of a flexible photoconductive member, comprising:

a developer unit including a developer roll defining a centerpoint thereof, said roll positioned opposed from the surface of the flexible photoconductive member, for developing the latent image with developer material; and a backing member defining a centerpoint thereof, said backing member having an arcuate surface defining a centerpoint thereof, said arcuate surface in engagement with a surface of the flexible photoconductive member opposed from the surface having the latent image recorded thereon with the flexible photoconductive member being wrapped about at least a portion of the arcuate surface of said backing member to form a negative wrap angle opposed from said developer unit, the centerpoint of the developer roll, the centerpoint of the backing member and the centerpoint of the arcuate surface being colinear, wherein the negative wrap angle is less than 178 degrees so as to provide for a wrinkle free belt adjacent the development unit.

2. An apparatus as in claim 1, further comprising an outer layer of insulating material at least where said member contacts said photoconductive member.

3. An apparatus as in claim 1, wherein said backing member comprises a thin walled shell.

4. An apparatus as in claim 3, wherein said backing member further comprises mounting means attached to said shell.

5. An apparatus as in claim 4, wherein said mounting means comprises a plug attached to said shell.

6. An apparatus as in claim 3, wherein said backing member further comprises a foam material located in said shell.

7. An apparatus for developing a latent image recorded on a surface of a flexible photoconductive member, comprising:

a developer unit including a developer roll defining a centerpoint thereof, said roll positioned opposed from the surface of the flexible photoconductive member, for developing the latent image with developer material; and a backing member defining a centerpoint thereof, said backing member having an arcuate surface defining a centerpoint thereof, said arcuate surface in engagement with a surface of the flexible photoconductive member opposed from the surface having the latent image recorded thereon with the flexible photoconductive member being wrapped about at least a portion of the arcuate surface of said backing member to form a negative wrap angle opposed from said developer unit, the centerpoint of the developer roll, the centerpoint of the backing member and the centerpoint of the arcuate surface being colinear, wherein said backing member comprises a thin walled shell, said shell comprising nickel material.

8. A backing member adapted to support a flexible photoconductive member having a latent image recorded on a surface developed by a developer unit positioned opposed from the surface, comprising:

a first arcuate portion;

a second arcuate portion spaced from and substantially parallel to said first arcuate portion;

a third arcuate portion connected to a first end portion of said first arcuate portion and to a first end portion of said second arcuate portion; and a fourth arcuate portion, opposed to said third arcuate portion and connected to a second end portion of said first arcuate portion and to a second end portion of said second arcuate portion, said first arcuate portion in contact with a surface of the flexible photoconductive member opposed from the surface having the latent image recorded thereon.

9. A backing member as in claim 8, wherein said backing member comprises a nickel material.

10. A backing member as in claim 9, wherein said backing member comprises an electroplated nickel material.

11. A backing member as in claim 9, wherein said first arcuate portion defines a first arc of a first circle having a first centerpoint and wherein said second arcuate portion defines a second arc of a second circle having a second centerpoint, the first centerpoint being coincident with the second centerpoint.

12. An electrophotographic printing machine of the type adapted to develop with toner an electrostatic latent image recorded on a photoconductive member, comprising:

a developer unit including a developer roll defining a centerpoint thereof, said roll positioned opposed from the surface of the flexible photoconductive member, for developing the latent image with developer material; and a backing member defining a centerpoint thereof, said backing member having an arcuate surface defining a centerpoint thereof, said arcuate surface in engagement with a surface of the flexible photoconductive member opposed from the surface having the latent image recorded thereon with the flexible photoconductive member being wrapped about at least a portion of the arcuate surface of said backing member to form a negative wrap angle opposed from said developer unit, the centerpoint of the developer roll, the centerpoint of the backing member and the centerpoint of the arcuate surface being colinear, wherein the negative wrap angle is less than 178 degrees so as to provide for a wrinkle free belt adjacent the developing unit.

13. A printing machine as in claim 12, further comprising an outer layer of insulating material at least where said member contacts said photoconductive member.

14. A printing machine as in claim 12, wherein said backing member comprises a thin walled shell.

15. A printing machine as in claim 14, wherein said backing member further comprises mounting means attached to said shell.

16. A printing machine as in claim 15, wherein said mounting means comprises a plug attached to said shell.

17. A printing machine as in claim 14, wherein said backing member further comprises a foam material located in said shell.

18. An electrophotographic printing machine of the type adapted to develop with toner an electrostatic latent image recorded on a photoconductive member, comprising:

a developer unit including a developer roll defining a centerpoint thereof, said roll positioned opposed from the surface of the flexible photoconductive member, for developing the latent image with developer material; and a backing member defining a centerpoint thereof, said backing member having an arcuate surface defining a centerpoint thereof, said arcuate surface in engagement with a surface of the flexible photoconductive member opposed from the surface having the latent image recorded thereon with the flexible photoconductive member being wrapped about at least a portion of the arcuate surface of said backing member to form a negative wrap angle opposed from said developer unit, the centerpoint of the developer roll, the centerpoint of the backing member and the centerpoint of the arcuate surface being colinear, wherein said backing member comprises a thin walled shell, said shell comprising nickel material.

* * * * *